US009711877B2

(12) United States Patent
Leng et al.

(10) Patent No.: US 9,711,877 B2
(45) Date of Patent: Jul. 18, 2017

(54) PLUG AND CONNECTOR MODULE

(71) Applicant: Huawei Device Co., Ltd., Shenzhen (CN)

(72) Inventors: Aimin Leng, Shenzhen (CN); Menglong Zhao, Shenzhen (CN); Bin Zhang, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 0 days.

(21) Appl. No.: 14/955,513

(22) Filed: Dec. 1, 2015

(65) Prior Publication Data

US 2016/0118730 A1 Apr. 28, 2016

Related U.S. Application Data

(63) Continuation of application No. PCT/CN2014/076970, filed on May 7, 2014.

(51) Int. Cl.
*H01R 12/57* (2011.01)
*H01R 12/70* (2011.01)
(Continued)

(52) U.S. Cl.
CPC ..... *H01R 12/57* (2013.01); *H01R 12/707* (2013.01); *H01R 13/6582* (2013.01);
(Continued)

(58) Field of Classification Search
CPC .... H01R 12/57; H01R 2107/00; H01R 24/60; H01R 13/665
(Continued)

(56) References Cited

U.S. PATENT DOCUMENTS 5,435,744 A 7/1995 Derstine et al.
5,975,957 A 11/1999 Noda et al.
(Continued)

FOREIGN PATENT DOCUMENTS

CN 201163689 Y 12/2008
CN 102185205 A 9/2011
(Continued)

OTHER PUBLICATIONS

Foreign Communication From a Counterpart Application, European Application No. 14891129.0, May 9, 2016, 7 pages.
(Continued)

*Primary Examiner* — Edwin A. Leon
(74) *Attorney, Agent, or Firm* — Conley Rose, P.C.

(57) ABSTRACT

A plug is disposed on a circuit board to be plug-connected to a socket, where the plug includes a metal housing and a spring pin, where the metal housing includes a first side plate and a second side plate that are oppositely disposed, and a first mating hole is formed on the second side plate; the spring pin is disposed on the second side plate along an insertion/removing direction of the plug, the spring pin includes a first connecting part and a bending part that is formed by bending and extending a first end of the first connecting part, a second end of the first connecting part is fastened inside the first mating hole, and the bending part is corresponding to the first mating hole and is separated from the second side plate.

16 Claims, 8 Drawing Sheets

(51) Int. Cl.

| | |
|---|---|
| ***H01R 13/6582*** | (2011.01) |
| ***H01R 13/66*** | (2006.01) |
| ***H01R 24/60*** | (2011.01) |
| *H01R 12/72* | (2011.01) |
| *H01R 13/6594* | (2011.01) |
| *H01R 24/62* | (2011.01) |
| *H01R 107/00* | (2006.01) |

(52) U.S. Cl.
CPC ..... *H01R 13/665* (2013.01); *H01R 24/60* (2013.01); *H01R 12/722* (2013.01); *H01R 13/6594* (2013.01); *H01R 24/62* (2013.01); *H01R 2107/00* (2013.01)

(58) Field of Classification Search
USPC ..... 439/83, 620.21, 676
See application file for complete search history.

(56) References Cited

U.S. PATENT DOCUMENTS

| | | | | |
|---|---|---|---|---|
| 9,190,781 | B2 * | 11/2015 | Chang | H01R 13/6683 |
| 2008/0227339 | A1 | 9/2008 | Lee | |
| 2009/0111330 | A1 * | 4/2009 | Lin | H01R 13/65802 439/638 |
| 2009/0142964 | A1 | 6/2009 | Wang | |
| 2011/0281449 | A1 | 11/2011 | Ko | |
| 2012/0276777 | A1 * | 11/2012 | Lv | H01R 13/6581 439/607.01 |
| 2013/0303027 | A1 | 11/2013 | Hsu et al. | |
| 2013/0316568 | A1 | 11/2013 | Yu et al. | |

FOREIGN PATENT DOCUMENTS

| | | | |
|---|---|---|---|
| CN | 202797354 | U | 3/2013 |
| CN | 202856080 | U | 4/2013 |
| CN | 103117465 | A | 5/2013 |
| CN | 203503831 | U | 3/2014 |
| JP | H07320815 | A | 12/1995 |
| JP | H10289760 | A | 10/1998 |
| JP | 2002015818 | A | 1/2002 |
| JP | 3148413 | U | 2/2009 |
| JP | 2009176423 | A | 8/2009 |

OTHER PUBLICATIONS

Partial English Translation and Abstract of Chinese Patent Application No. CN203503831U, Nov. 13, 2015, 3 pages.
Foreign Communication From a Counterpart Application, PCT Application No. PCT/CN2014/076970, English Translation of International Search Report dated Jan. 16, 2015, 2 pages.
Foreign Communication From a Counterpart Application, PCT Application No. PCT/CN2014/076970, Written Opinion dated Jan. 16, 2015, 4 pages.
Partial English Translation and Abstract of Chinese Patent Application No. CN103117465, Dec. 13, 2016, 8 pages.
Partial English Translation and Abstract of Chinese Patent Application No. CN202797354, Dec. 13, 2016, 9 pages.
Partial English Translation and Abstract of Chinese Patent Application No. CN202856080, Dec. 13, 2016, 7 pages.
Foreign Communication From a Counterpart Application, Chinese Application No. 2014800239909, Chinese Search Report dated Nov. 3, 2016, 2 pages.
Foreign Communication From a Counterpart Application, Chinese Application No. 2014800239909, Chinese Office Action dated Nov. 16, 2016, 9 pages.
Partial English Translation and Abstract of Japanese Patent Application No. JP200215818, Dec. 7, 2016, 14 pages.
Partial English Translation and Abstract of Japanese Patent Application No. JPA2009176423, Dec. 7, 2016, 25 pages.
Partial English Translation and Abstract of Japanese Patent Application No. JPH07320815, Dec. 7, 2016, 11 pages.
Partial English Translation and Abstract of Japanese Patent Application No. JPH10289760, Dec. 7, 2016, 15 pages.
Partial English Translation and Abstract of Japanese Patent Application No. JPU3148413, Dec. 7, 2016, 18 pages.
Foreign Communication From a Counterpart Application, PCT Application No. 2016-517137, Chinese Application No. 2016-517137, Chinese Office Action dated Oct. 18, 2016, 5 pages.
Foreign Communication From a Counterpart Application, PCT Application No. 2016-517137, Chinese Application No. 2016-517137, English Translation of Chinese Office Action dated Oct. 18, 2016, 6 pages.

* cited by examiner

PLUG AND CONNECTOR MODULE

CROSS-REFERENCE TO RELATED APPLICATIONS

This application is a continuation of International Application No. PCT/CN2014/076970, filed on May 7, 2014, which is hereby incorporated by reference in its entirety.

TECHNICAL FIELD

The present disclosure relates to the field of communications technologies, and in particular, to a plug and a connector module.

BACKGROUND

A Universal Serial Bus (USB) plug has a function of plug-and-play, and is widely used in the field of electronic devices. A male of an existing USB connector generally includes a metal housing, a rubber core, a metal terminal, an insulation base, and a metal hook. The metal terminal and the rubber core are disposed inside the metal housing, the metal housing extends out from the plastic base, an opening is formed inside the metal housing, one end of the metal hook is connected to the insulation base, and the other end appears out of the opening and protrudes from the metal housing.

Because the metal hook needs to be fastened on the insulation base, an insulation base has to be disposed on the USB plug. The insulation base is relatively thick, and therefore, a size of the USB plug increases and a structure is also relatively complex.

SUMMARY

A technical problem to be resolved in embodiments of the present disclosure is to provide a plug and a plug assembly, so as to resolve a problem that a plug has a relatively large size and has a relatively complex structure.

According to a first aspect, a plug is provided, which is configured to be disposed on a circuit board to be plug-connected to a socket, where the plug includes a metal housing and a spring pin, where the metal housing includes a first side plate and a second side plate that are oppositely disposed, and a first mating hole is formed on the second side plate; the spring pin is disposed on the second side plate along an insertion/removing direction of the plug, the spring pin includes a first connecting part and a bending part that is formed by bending and extending a first end of the first connecting part, a second end of the first connecting part is fastened inside the first mating hole, such that the spring pin is fixedly disposed on the second side plate, and the bending part is corresponding to the first mating hole and is separated from the second side plate; when the plug is not plug-connected to the socket, a natural end of the bending part remains in a state of being separated from the second side plate; and when the plug is plug-connected to the socket, elastic deformation occurs on the bending part, and all or a part of the bending part is accommodated inside the first mating hole.

In a first possible implementation manner of the first aspect, the spring pin further includes a second connecting part, and the second connecting part is formed by bending and extending the natural end of the bending part towards a length direction of the spring pin.

With reference to the first possible implementation manner of the first aspect, in a second possible implementation manner, when the plug is not plug-connected to the socket, a natural end of the second connecting part is in a state of being separated from the second side plate.

With reference to the first possible implementation manner of the first aspect, in a third possible implementation manner, a natural end of the second connecting part is fastened inside the first mating hole.

With reference to any one of the first to third possible implementation manners of the first aspect, in a fourth possible implementation manner, the plug further includes a rubber core and multiple metal terminals, where the rubber core is accommodated between the first side plate and the second side plate, the rubber core has a first end and a second end that are oppositely disposed, the first end of the rubber core is corresponding to a first end of the metal housing and reaches out from the first end of the metal housing, the second end of the rubber core is corresponding to a second end that is of the metal housing and is opposite to the first end, multiple accommodating grooves are formed on the rubber core, and the accommodating grooves are formed along a length direction of the rubber core and run through the first end of the rubber core; and the metal terminals are accommodated inside the accommodating grooves, a first end of each metal terminal is corresponding to the first end of the rubber core, each metal terminal reaches out from the first end of the metal housing, so as to be plug-connected to the socket, a second end of each metal terminal is corresponding to the second end of the rubber core, and the second end of each metal terminal reaches out from the second end of the metal housing, so as to be electrically connected to the circuit board.

With reference to the fourth possible implementation manner of the first aspect, in a fifth possible implementation manner, a plug pin is disposed on the metal housing near the second end of the metal housing, and the plug pin is welded to the circuit board, such that the plug is disposed on the circuit board.

With reference to the fifth possible implementation manner of the first aspect, in a sixth possible implementation manner, the rubber core includes a main body part and a positioning part, a first end of the main body part serves as the first end of the rubber core and is corresponding to the first end of the metal housing, a second end of the main body part extends along a length direction and a width direction of the rubber core to form the positioning part, the positioning part is corresponding to the second end of the metal housing, the plug pin is disposed in a bending manner on the second end that is of the metal housing and is corresponding to the second side plate, such that buckle space is formed between the plug pin and the second end of the metal housing, and the positioning part is buckled inside the buckle space, such that the rubber core is fastened inside the metal housing.

With reference to the fourth possible implementation manner of the first aspect, in a seventh possible implementation manner, a main body part of the rubber core includes an upper surface and a lower surface that are oppositely disposed, the upper surface is corresponding to the first side plate, the lower surface is corresponding to the second side plate, the multiple accommodating grooves are formed on the lower surface, a fixture component is disposed on the upper surface, and a second mating hole is disposed on the second side plate, so as to camp and fasten the fixture component, such that the rubber core is fastened inside the metal housing.

With reference to the fourth possible implementation manner of the first aspect, in an eighth possible implementation manner, the metal housing further includes a first lead pin and a second lead pin, the first lead pin is disposed on the first end that is of the metal housing and is corresponding to the first side plate, the second lead pin is disposed on the second end that is of the metal housing and is corresponding to the second side plate, the first lead pin tilts towards the second side plate, and the second lead pin tilts towards the first side plate.

According to a second aspect, a plug assembly is provided, which is configured to be plug-connected to a socket, where the plug assembly includes a circuit board and the plug according to any one of the foregoing possible implementation manners, the plug is disposed on the circuit board and is electrically connected to the circuit board, and when the socket is plug-connected to the plug, the socket is electrically connected to the circuit board using the plug.

According to the plug provided in the implementation manners, a spring pin is disposed on a second side plate of a metal housing, and can directly sense elasticity when the plug is inserted and removed; in addition, the spring pin is directly disposed on the second side plate without a need of an insulation base with a relatively large size for fastening, thereby achieving an objective of reducing a size of the plug and simplifying a structure of the plug.

BRIEF DESCRIPTION OF DRAWINGS

To describe the technical solutions in the embodiments of the present disclosure more clearly, the following briefly introduces the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
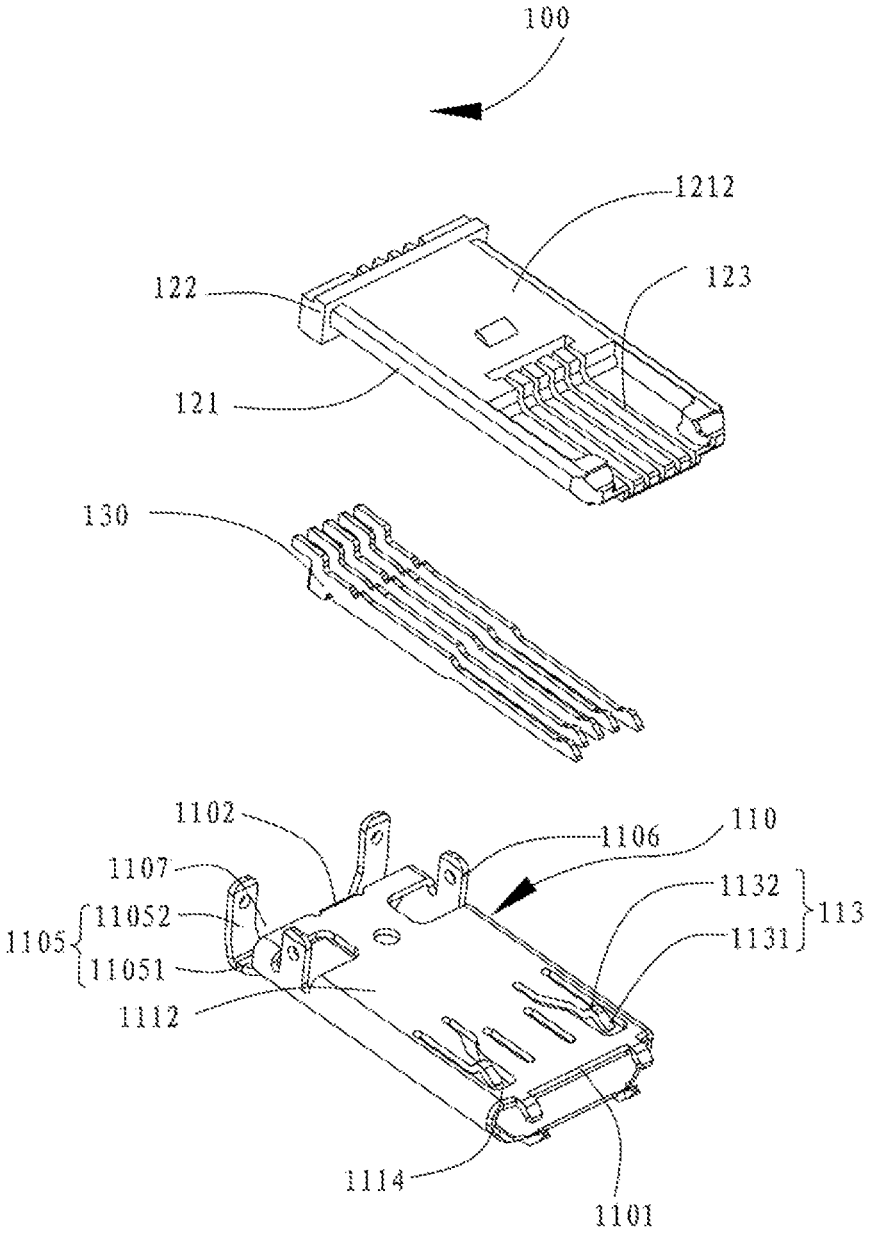
FIG. 1 is an exploded view of a plug according to a first exemplary implementation manner of a first solution of the present disclosure.
Figure 2:
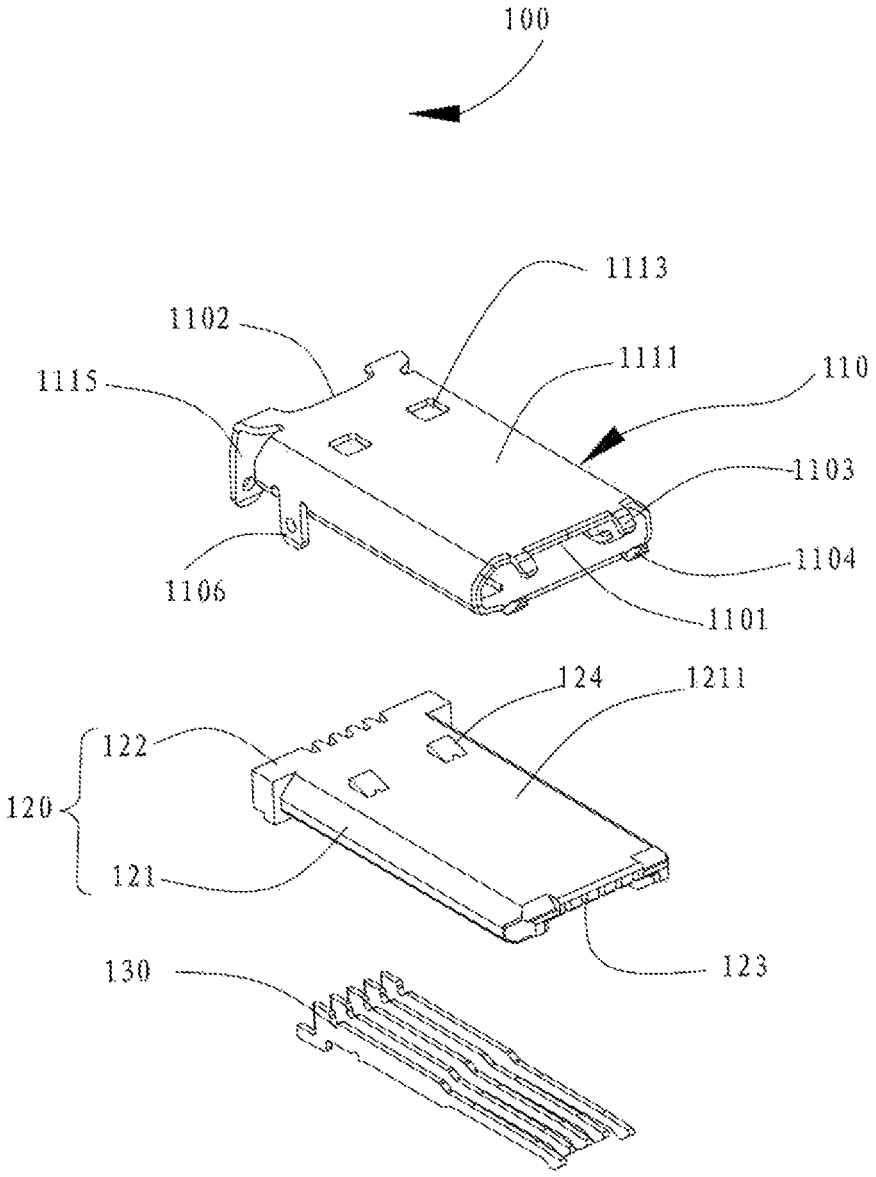
FIG. 2 is an exploded view of the plug in FIG. 1 in another direction.
Figure 3:
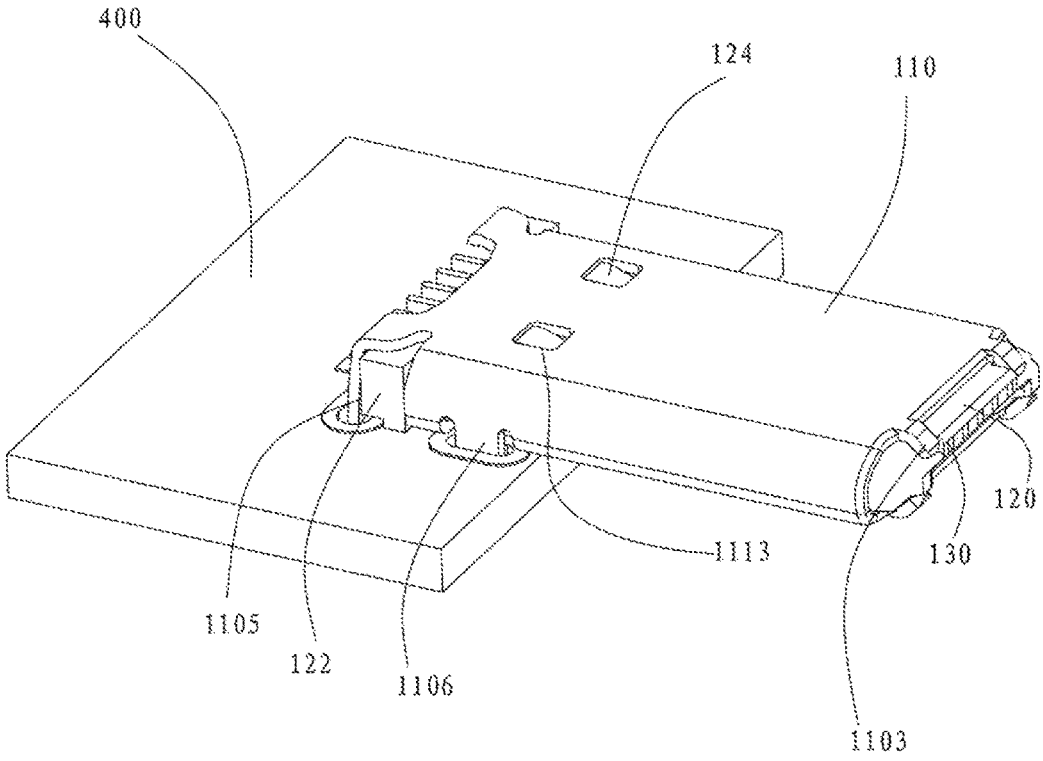
FIG. 3 is a schematic diagram of a connection between the plug in FIG. 1 and a circuit board.
Figure 4:
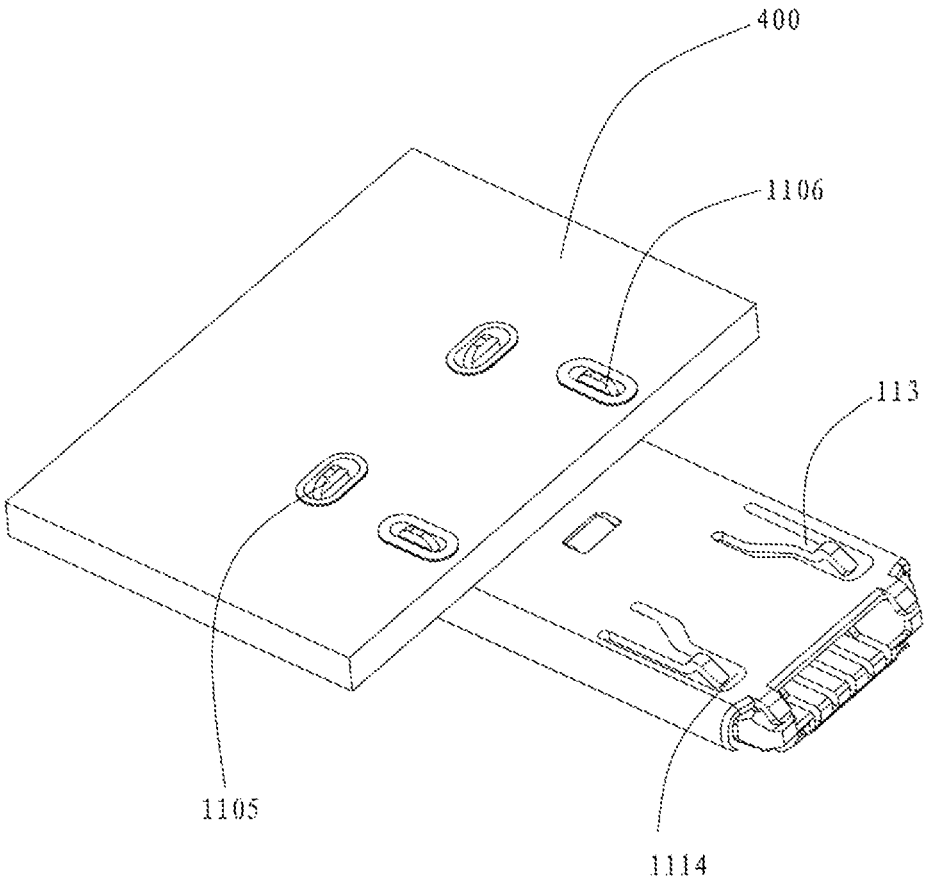
FIG. 4 is a schematic diagram of a connection, in another direction, between the plug in FIG. 1 and a circuit board.

Referring to FIG. 1 and FIG. 2, FIG. 1 and FIG. 2 show a plug 100 provided in an exemplary implementation manner of a first technical solution of the present disclosure. The plug 100 is configured to be disposed on a circuit board 400 (FIG. 3 and FIG. 4) to be plug-connected to a socket.

The plug 100 includes a metal housing 110 and a spring pin 113. The metal housing 110 includes a first side plate 1111 and a second side plate 1112 that are oppositely disposed. A first mating hole 1114 is formed on the second side plate 1112. The spring pin 113 is disposed on the second side plate 1112 along an insertion/removing direction I of the plug. The spring pin 113 includes a first connecting part 1131 and a bending part 1132 that is formed by bending and extending a first end of the first connecting part 1131. A second end of the first connecting part 1131 is fastened inside the first mating hole 1114, such that the spring pin 113 is fixedly disposed on the second side plate 1112. The bending part 1132 is corresponding to the first mating hole 1114 and is separated from the second side plate 1112. When the plug 100 is not plug-connected to the socket, a natural end of the bending part 1132 remains in a state of being separated from the second side plate; and when the plug is plug-connected to the socket, elastic deformation occurs on the bending part 1132, and all or a part of the bending part 1132 is accommodated inside the first mating hole 1114.

The metal housing 110 is substantially in a shape of a hollow quadrangular prism. There are two spring pins 113, and the two spring pins 113 are disposed, in parallel to each other, on the second side plate 1112. There are two first mating holes 1114, and one spring pin 113 is corresponding to one first mating hole 1114.

In this implementation manner, a spring pin 113 is disposed on a second side plate 1112 of the metal housing 110, and can directly sense elasticity when a plug is inserted and removed; in addition, the spring pin 113 is directly disposed on the second side plate 1112 without a need of an insulation base with a relatively large size for fastening, thereby achieving an objective of reducing a size of the plug 100 and simplifying a structure of the plug 100.

Still referring to FIG. 1 and FIG. 2, further, the metal housing 110 includes a first end 1101 and a second end 1102 that are oppositely disposed. A first plug pin 1105 is disposed on the metal housing 110 near the second end 1102 of the metal housing 110. The first plug pin 1105 is configured to weld to the circuit board 400, such that the plug 100 is disposed on the circuit board 400.

In this implementation manner, there are two first plug pins 1105. The first plug pin 1105 is roughly in an L shape. The first plug pin 1105 includes a connecting part 11051 and a welding part 11052 that is formed by vertically extending a first end of the connecting part 11051. A second end of the connecting part 11051 is disposed on the second end 1102 of the first metal housing 110, and is connected to the first side plate 1111. An end part of the first welding part 11052 is configured to weld to the circuit board 400, so as to fasten the plug 100 in a first direction. Buckle space 1107 is formed between the second end 1102 of the metal housing 110 and the welding part 11052.

A second plug pin 1106 may also be disposed on a side edge of the second side plate 1112, so as to fasten the plug 100 in a second direction. The first direction is a length direction of the plug 100, and the second direction is a width direction of the plug 100.

In another implementation manner, quantities and shapes of first plug pins 1105 and second plug pins 1106 may be adjusted according to an actual demand.

Further, the plug 100 further includes a rubber core 120 and multiple metal terminals 130. The rubber core 120 is accommodated between the first side plate 1111 and the second side plate 1112. The rubber core 120 has a first end and a second end that are oppositely disposed. The metal housing 110 has the first end 1101 and the second end 1102 that are oppositely disposed. The first end of the rubber core 120 is corresponding to the first end 1101 of the metal housing 110 and reaches out from the first end 1101 of the metal housing 110. The second end of the rubber core 120 is corresponding to the second end 1102 that is of the metal housing 110 and is opposite to the first end 1101. Multiple accommodating grooves 123 are formed on the rubber core 120. The accommodating grooves 123 are formed along a length direction of the rubber core 120, and run through the first end of the rubber core 120. The metal terminals 130 are accommodated inside the accommodating grooves 123. A first end of each metal terminal 130 is corresponding to the first end of the rubber core 120. Each metal terminal 130 reaches out from the first end 1101 of the metal housing 110, so as to be plug-connected to the socket. A second end of each metal terminal 130 is corresponding to the second end of the rubber core 120. The second end of each metal terminal 130 reaches out from the second end 1102 of the metal housing 110, so as to be electrically connected to the circuit board 400.

More specifically, the rubber core 120 includes a main body part 121 and a positioning part 122. A first end of the main body part 121 serves as the first end of the rubber core 120 and is corresponding to the first end 1101 of the metal housing 110. A second end of the main body part 121 extends along a length direction and a width direction of the rubber core 120 to form the positioning part 122. The positioning part 122 is corresponding to the second end 1102 of the metal housing 110. The positioning part 122 is buckled inside the buckle space, such that the rubber core 120 is fastened inside the metal housing 110.

A shape of the main body part 121 of the rubber core 120 is corresponding to a shape of the metal housing 110. The accommodating grooves 123 are separated from each other and are corresponding to the metal terminals 130 in shape. Each accommodating groove 123 accommodates one metal terminal 130.

Further, the main body part 121 of the rubber core 120 includes an upper surface 1211 and a lower surface 1212 that are oppositely disposed. The upper surface 1211 is corresponding to the first side plate 1111, and the lower surface 1212 is corresponding to the second side plate 1112. The multiple accommodating grooves 123 are formed on the lower surface 1212. A fixture component 124 is disposed on the upper surface 1211. A second mating hole 1113 that is corresponding to the fixture component 124 is disposed on the first side plate 1111, so as to camp and fasten the fixture component 124, such that the rubber core 120 is fastened inside the metal housing 110.

The metal housing 110 further includes a first lead pin 1103 and a second lead pin 1104. The first lead pin 1103 is disposed on the first end 1101 of the metal housing 110, and is located in an extension direction of the first side plate 1111. The second lead pin 1104 is disposed on the first end 1101 of the metal housing 110, and is located in an extension direction of the second side plate 1112. The first lead pin 1103 tilts towards the second side plate 1112, and the second lead pin 1104 tilts towards the first side plate 1111. Therefore, the first lead pin 1103 and the second lead pin 1104 stay close to each other to form a chamfered structure to play a guiding role, such that the plug 100 is more easily inserted into the socket.

In this implementation manner, there are two first lead pins 1103 and two second lead pins 1104.

Similarly, a chamfered structure is also formed at the first end of the rubber core 120 to play a guiding role, such that the first end of the rubber core 120 is plug-connected to the socket.

Figure 5:
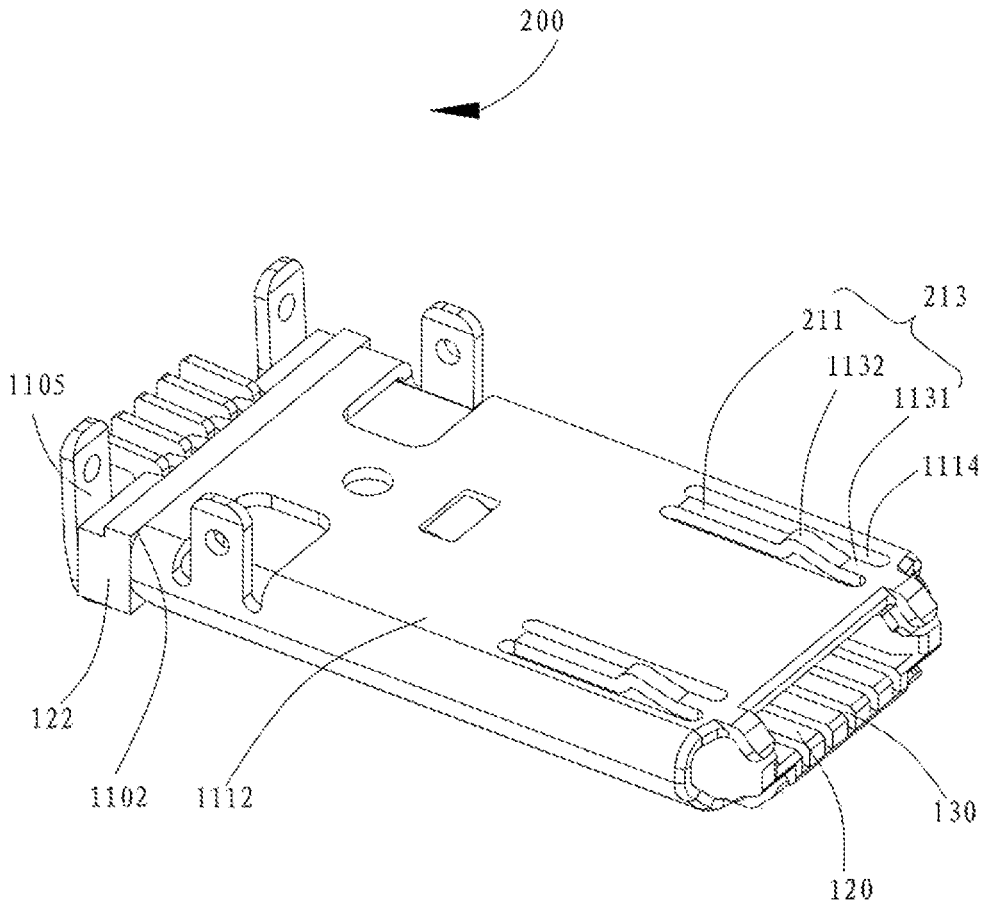
FIG. 5 is a schematic diagram of a plug according to a second exemplary implementation manner of a first solution of the present disclosure.
Figure 6:
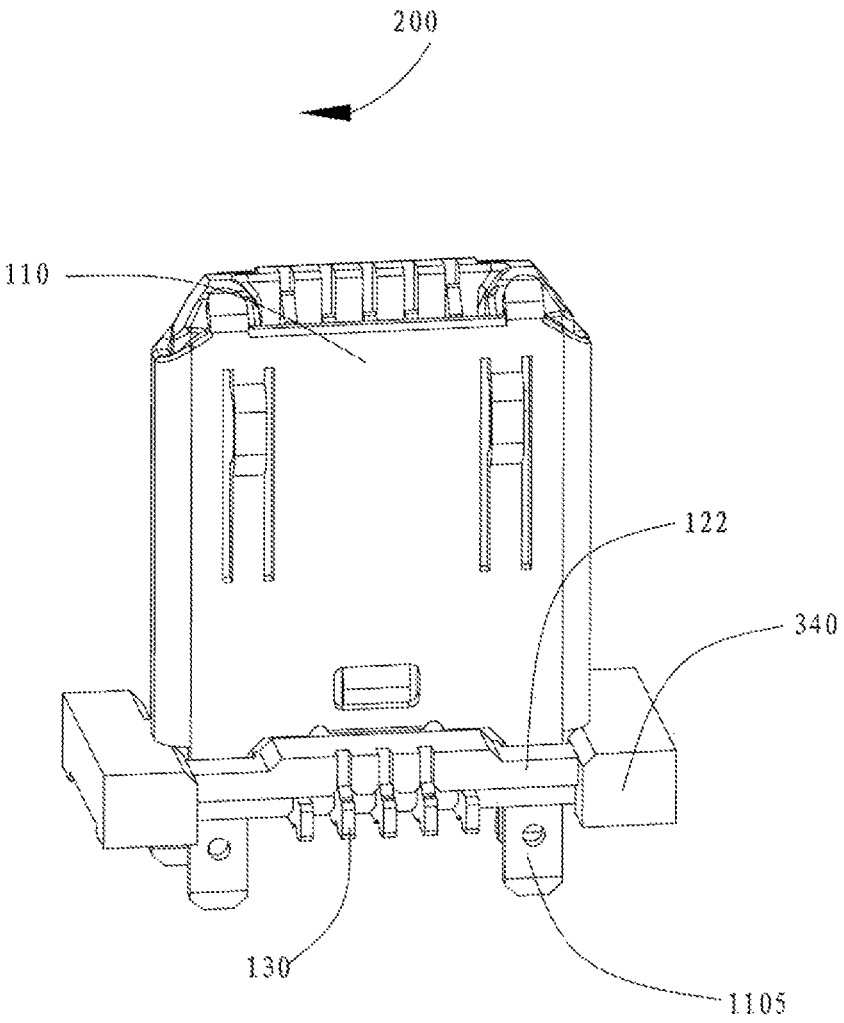
FIG. 6 is a schematic diagram of the plug in FIG. 5 in another direction.

Referring to FIG. 5 and FIG. 6, FIG. 5 and FIG. 6 show a plug 200 provided in a second exemplary implementation manner of a first solution of the present disclosure. The plug 200 provided in the second exemplary implementation manner is similar to the plug 100 provided in the first exemplary implementation manner, and a difference between them lies in that, in the second exemplary implementation manner, a spring pin 213 further includes a second connecting part 211. The second connecting part 211 is formed by bending and extending the natural end of the bending part 1132 along a length direction of the spring pin 213. A natural end of the second connecting part 211 is fastened inside the first mating hole 1114. In another implementation manner, the natural end of the second connecting part 211 may also be in a natural state, and when the plug is not plug-connected to the socket, the natural end of the second connecting part is in a state of being separated from the second side plate.

Further, the plug 200 may further include two insulation supporting blocks 340. The insulation supporting blocks 340 are disposed on both sides of the positioning part 122 of the rubber core 120, and are mutually connected to the positioning part 122. The insulation supporting blocks 340 may play a supporting role when the plug 200 is inserted into the circuit board.

Figure 7:
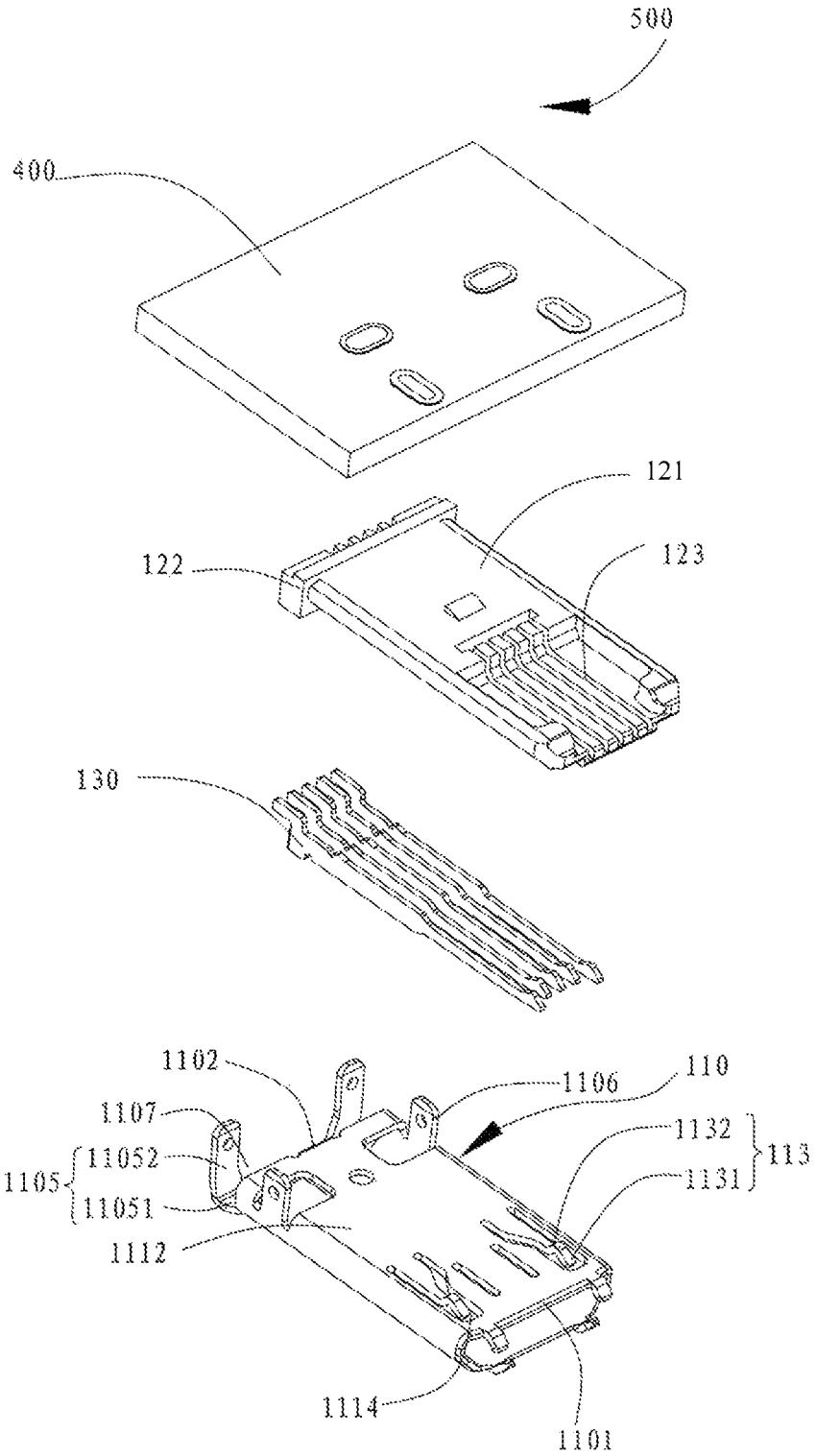
FIG. 7 is an exploded view of a plug assembly according to an exemplary implementation manner of a second solution of the present disclosure.
Figure 8:
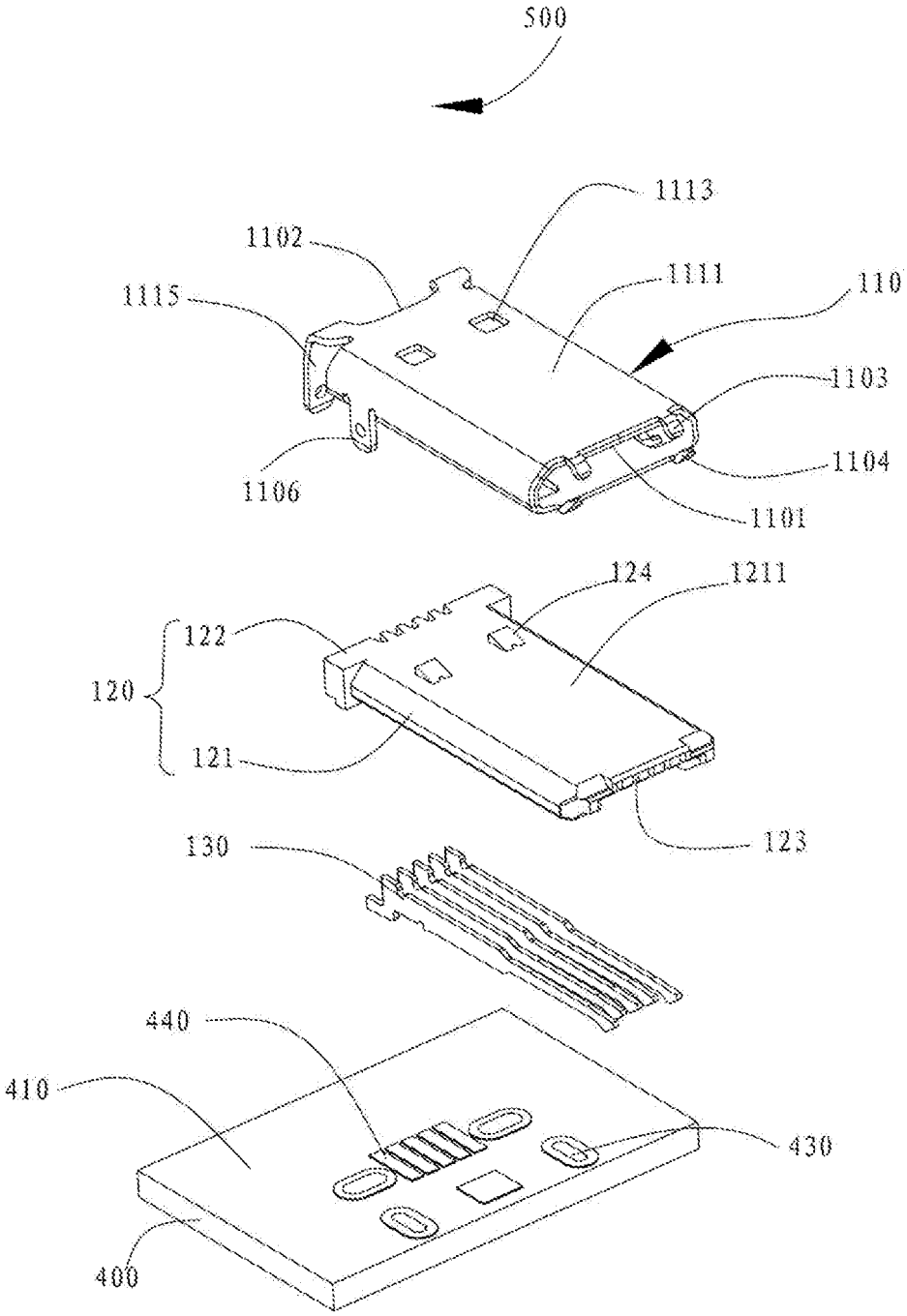
FIG. 8 is an exploded view of a plug assembly in another direction according to an exemplary implementation manner of a second solution of the present disclosure.

Referring to FIG. 7 and FIG. 8, an exemplary implementation manner of a second solution of the present disclosure further provides a plug assembly 500. The plug assembly 500 is configured to be plug-connected to a socket. The plug assembly 500 includes the circuit board 400 and the plug according to the first or second exemplary implementation manner of the first solution. The plug is disposed on the circuit board 400 and is electrically connected to the circuit board 400. When the socket is plug-connected to the plug, the socket is electrically connected to the circuit board 400 using the plug.

The circuit board 400 has a first surface 410. An installation hole 430 running through the circuit board 400 is formed inside the circuit board 400. The installation hole 430 is configured to be plug-connected to the first plug pin 1105 and the second plug pin 1106. In this implementation manner, there are four installation holes 430, and a distribution manner of the four installation holes 430 is the same as a distribution manner of corresponding plug pins. The first plug pin 1105 and the second plug pin 1106 may be fastened inside the installation holes 430 in a soldering manner. A metal pad 440 that is corresponding to a metal terminal 130 is formed on the first surface 410 of the circuit board 400. When the plug is fixed on the circuit board 400, each metal terminal 130 is electrically connected to one corresponding metal pad 440.

In the present disclosure, a spring pin 113 is disposed on a second side plate 1112 of the metal housing 110, and can directly sense elasticity when a plug is inserted and removed. In addition, the spring pin 113 is directly disposed on the second side plate 1112 without a need of an insulation base with a relatively large size for fastening, thereby achieving an objective of reducing a size of the plug 100 and simplifying a structure of the plug 100.

Finally, it should be noted that the foregoing embodiments are merely intended for describing the technical solutions of the present disclosure, but not for limiting the present disclosure. Although the present disclosure is described in detail with reference to the foregoing embodiments, a person of ordinary skill in the art should understand that the descriptions are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A plug configured to be disposed on a circuit hoard to be plug-connected to a socket, wherein the plug comprises:
- a metal housing; and
- a spring pin,
- wherein the metal housing comprises a first side plate and a second side plate that are oppositely disposed,
- wherein a first mating hole is fanned on the second side plate,
- wherein the spring pin is disposed on the second side plate along an insertion/removing direction of the plug,
- wherein the spring pin comprises a first connecting part and a bending part that is formed by bending and extending a first end of the first connecting part,
- wherein a second end of the first connecting part is fastened inside the first mating hole, such that the spring pin is fixedly disposed on the second side plate,
- wherein the bending part is corresponding to the first mating hole and is separated from the second side plate,
- wherein, when the plug is not plug-connected to the socket, a natural end of the bending part remains in a state of being separated from the second side plate,
- wherein, when the plug is plug-connected to the socket, elastic deformation occurs on the bending part, and all or a part of the bending part is accommodated inside the first mating hole,
- wherein the plug further comprises a rubber core and multiple metal terminals,
- wherein the rubber core is accommodated between the first side plate and the second side plate,
- wherein the rubber core has a first end and a second end that are oppositely disposed,
- wherein the first end of the rubber core is corresponding to a first end of the metal housing and reaches out from the first end of the metal housing,
- wherein the second end of the rubber core is corresponding to a second end of the metal housing that is opposite to the first end,
- wherein multiple accommodating grooves are formed on the rubber core,
- wherein the accommodating grooves are formed along a length direction of the rubber core and run through the first end of the rubber core,
- wherein the metal terminals are accommodated inside the accommodating grooves,
- wherein a first end of each metal terminal is corresponding to the first end of the rubber core,
- wherein each metal terminal reaches out from the first end of the metal housing, so as to be plug-connected to the socket,
- wherein a second end of each metal terminal is corresponding to the second end of the rubber core, and
- wherein the second end of each metal terminal reaches out from the second end of the metal housing, so as to be electrically connected to the circuit board.

2. The plug according to claim 1 , wherein the spring pin further comprises a second connecting part, and wherein the second connecting part is formed by bending and extending the natural end of the bending part towards a length direction of the spring pin.

3. The plug according to claim 2, wherein, when the plug is not plug-connected to the socket, a natural end of the second connecting part is in a state of being separated from the second side plate.

4. The plug according to claim 2, wherein a natural end of the second connecting part is fastened inside the first mating hole.

5. The plug according to claim 1, wherein a plug pin is disposed on the metal housing near the second end of the metal housing, and wherein the plug pin is welded to the circuit board, such that the plug is disposed on the circuit board.

6. The plug according to claim 5, wherein the rubber core comprises:
- a main body part; and
- a positioning part,
- wherein a first end of the main body part serves as the first end of the rubber core and is corresponding to the first end of the metal housing,
- wherein a second end of the main body part extends along a length direction and a width direction of the rubber core to form the positioning part,
- wherein the positioning part is corresponding to the second end of the metal housing,
- wherein the plug pin is disposed in a bending manner on the second end that is of the metal housing and is corresponding to the second side plate, such that buckle space is formed between the plug pin and the second end of the metal housing, and
- wherein the positioning part is buckled inside the buckle space, such that the rubber core is fastened inside the metal housing.

7. The plug according to claim 1, wherein a main body part of the rubber core comprises:
- an upper surface; and
- a lower surface that are oppositely disposed,
- wherein the upper surface is corresponding to the first side plate,
- wherein the lower surface is corresponding to the second side plate,
- wherein the multiple accommodating grooves are formed on the lower surface,
- wherein a fixture component is disposed on the upper surface, and
- wherein a second mating hole is disposed on the second side plate, so as to camp and fasten the fixture component, such that the rubber core is fastened inside the metal housing.

8. The plug according to claim 1, wherein the metal housing further comprises:
- a first lead pin; and
- a second lead pin,
- wherein the first lead pin is disposed on the first end that is of the metal housing and is corresponding to the first side plate,
- wherein the second lead pin is disposed on the second end that is of the metal housing and is corresponding to the second side plate, wherein the first lead pin tilts towards the second side plate, and wherein the second lead pin tilts towards the first side plate.

9. A plug assembly configured to be plug-connected to a socket, wherein the plug assembly comprises:

a circuit board; and a plug, wherein the plug is configured to be disposed on the circuit board to be plug-connected to a socket, wherein the plug comprises a metal housing and a spring pin, wherein the metal housing comprises a first side plate and a second side plate that are oppositely disposed, wherein a first mating hole is formed on the second side plate, wherein the spring pin is disposed on the second side plate alone an insertion/removing direction of the plug, wherein the spring pin comprises a first connecting part and a bending part that is formed by bending and extending a first end of the first connecting part, wherein a second end of the first connecting part is fastened inside the first mating hole, such that the spring pin is fixedly disposed on the second side plate, wherein the bending part is corresponding to the first mating hole and is separated from the second side plate, wherein, when the plug is not plug-connected to the socket, a natural end of the bending part remains in a state of being separated from the second side plate, wherein, when the plug is plug-connected to the socket, elastic deformation occurs on the bending part, and all or a part of the bending part is accommodated inside the first mating hole, wherein the plug further comprises a rubber core and multiple metal terminals, wherein the rubber core is accommodated between the first side plate and the second side plate, wherein the rubber core has a first end and a second end that are oppositely disposed, wherein the first end of the rubber core is corresponding to a first end of the metal housing and reaches out from the first end of the metal housing, wherein the second end of the rubber core is corresponding to a second end of the metal housing that is opposite to the first end, wherein multiple accommodating grooves are formed on the rubber core, wherein the accommodating grooves are formed along a length direction of the rubber core and run through the first end of the rubber core, wherein the metal terminals are accommodated inside the accommodating grooves, wherein a first end of each metal terminal is corresponding to the first end of the rubber core, wherein each metal terminal reaches out from the first end of the metal housing, so as to be plug-connected to the socket, wherein a second end of each metal terminal is corresponding to the second end of the rubber core, and wherein the second end of each metal terminal reaches out from the second end of the metal housing, so as to be electrically connected to the circuit board.

10. The plug assembly according to claim 9, wherein the spring pin further comprises a second connecting part, and wherein the second connecting part is formed by bending and extending the natural end of the bending part towards a length direction of the spring pin.

11. The plug assembly according to claim 10, wherein, when the plug is not plug-connected to the socket, a natural end of the second connecting part is in a state of being separated from the second side plate.

12. The plug assembly according to claim 10, wherein a natural end of the second connecting part is fastened inside the first mating hole.

13. The plug assembly according to claim 9, wherein a plug pin is disposed on the metal housing near the second end of the metal housing, and wherein the plug pin is welded to the circuit board, such that the plug is disposed on the circuit board.

14. The plug assembly according to claim 13, wherein the rubber core comprises:

a main body part; and a positioning part, wherein a first end of the main body part serves as the first end of the rubber core and is corresponding to the first end of the metal housing, wherein a second end of the main body part extends along a length direction and a width direction of the rubber core to form the positioning part, wherein the positioning part is corresponding to the second end of the metal housing, wherein the plug pin is disposed in a bending manner on the second end that is of the metal housing and is corresponding to the second side plate, such that buckle space is formed between the plug pin and the second end of the metal housing, and wherein the positioning part is buckled inside the buckle space, such that the rubber core is fastened inside the metal housing.

15. The plug assembly according to claim 9, wherein a main body part of the rubber core comprises:

an upper surface; and a lower surface that are oppositely disposed, wherein the upper surface is corresponding to the first side plate, wherein the lower surface is corresponding to the second side plate, wherein the multiple accommodating grooves are formed on the lower surface, wherein a fixture component is disposed on the upper surface, and wherein a second mating hole is disposed on the second side plate, so as to camp and fasten the fixture component, such that the rubber core is fastened inside the metal housing.

16. The plug assembly according to claim 9, wherein the metal housing further comprises:

a first lead pin; and a second lead pin, wherein the first lead pin is disposed on the first end that is of the metal housing and is corresponding to the first side plate, wherein the second lead pin is disposed on the second end that is of the metal housing and is corresponding to the second side plate, wherein the first lead pin tilts towards the second side plate, and wherein the second lead pin tilts towards the first side plate.

* * * * *